United States Patent [19]

Janisch et al.

[11] Patent Number: 5,028,069

[45] Date of Patent: Jul. 2, 1991

[54] CENTERING SPRING FOR A FRONT SKI BINDING JAW

[75] Inventors: Andreas Janisch, Tribuswinkel; Johann Zotter, Vienna; Herbert Kurtschak, Wolfsthal, all of Austria

[73] Assignee: TMC Corporation, Baar/Zug, Switzerland

[21] Appl. No.: 453,620

[22] Filed: Dec. 19, 1989

[30] Foreign Application Priority Data

Dec. 20, 1988 [AT] Austria ..... 3092/88

[51] Int. Cl.[5] ..... A63C 9/085

[52] U.S. Cl. ..... 280/625; 280/629; 280/634

[58] Field of Search ..... 280/625, 626, 629, 630, 280/634, 628

[56] References Cited

U.S. PATENT DOCUMENTS

| | | | |
|---|---|---|---|
| 3,292,941 | 12/1966 | Berchtold et al. | 280/630 |
| 3,348,854 | 10/1967 | Marker et al. | 280/629 X |
| 3,455,570 | 7/1969 | Salomon | 280/629 |
| 3,638,959 | 2/1972 | Reuge | 280/625 |
| 3,642,298 | 2/1972 | Salomon | 280/629 |
| 3,751,055 | 8/1973 | Ishida | 280/630 |
| 3,943,882 | 3/1976 | Sollack et al. | 280/634 X |
| 3,945,657 | 3/1976 | Fredriksen | 280/630 |
| 4,062,563 | 12/1977 | Manfreda | 280/629 X |
| 4,087,114 | 5/1978 | Csosz | 280/629 X |
| 4,685,696 | 8/1987 | Sedlmair et al. | 280/629 X |
| 4,960,289 | 10/1990 | Stritzl et al. | 280/630 |

FOREIGN PATENT DOCUMENTS

| | | | |
|---|---|---|---|
| 351425 | 7/1979 | Austria . | |
| 1800691 | 11/1969 | Fed. Rep. of Germany | 280/625 |
| 3151767 | 7/1983 | Fed. Rep. of Germany | 280/634 |
| 1534441 | 7/1968 | France | 280/634 |

*Primary Examiner*—Andres Kashnikow
*Assistant Examiner*—Brian L. Johnson
*Attorney, Agent, or Firm*—Flynn, Thiel, Boutell & Tanis

[57] ABSTRACT

A ski binding front jaw has a ski-fixed housing, and two toggle levers which are rotatable about vertical axles, which have longer lever arms engageable with a ski boot, and which have shorter lever arms engageable with a slide member guided for movement in the housing and biased by a spring. A vertical bolt is provided between the two toggle levers, the bolt being supported in two prongs of the housing, the housing being forked at its end facing the ski boot, the bolt movably supporting a swingable sole down-holding part which may be biased by a compression spring. To ensure a reliable return of the sole down-holding part to its center position in this front jaw the sole down-holding part is yieldably maintained in its center position by a U-shaped leaf or wire spring serving as a return spring, a web of the spring being divided into two sections by a curved section, and the spring having its web facing the sole down-holding part.

19 Claims, 3 Drawing Sheets

CENTERING SPRING FOR A FRONT SKI BINDING JAW

FIELD OF THE INVENTION

The invention relates to a front jaw for a safety ski binding and, more particularly, to a front jaw which includes: a ski-fixed housing, a pair of toggle levers rotatable about two axles which are anchored in the housing and are perpendicular to the upper side of the ski, the toggle levers having long lever arms engageable with a ski boot and short lever arms engageable with a slide member guided in the housing for movement in a longitudinal direction of the housing and biased by a release spring, and a sole down-holding part supported adjustably in a vertical direction between the two toggle levers on a bolt extending perpendicular to the upper side of the ski, the bolt being supported in two prongs of the housing, which is forked at its end facing the ski boot, and the sole down-holding part being pivotal about the bolt and being yieldably maintained in a center position by a return spring.

BACKGROUND OF THE INVENTION

Such a front jaw is disclosed in Austrian Patent No. 351 425. The rotatable sole down-holding part is, in this known front jaw, adjustable in its vertical position for respective ski boot sole thicknesses by means of a threaded bolt. The housing of this front jaw includes a spring housing receiving a release spring and a support member attached to the spring housing. The sole down-holding part in this front jaw is yieldably maintained in its center position by an elastic block of rubber or plastic provided between the support member and the sole down-holding part, by means of which the sole down-holding part is returned to its center position after a lateral deflection.

The block of rubber or plastic in this embodiment has, in order to provide sufficient elasticity, a relatively large size or volume, thus making the jaw unnecessarily large. Furthermore, this design of a return spring cannot be used in certain state-of-the-art front jaws, because the automatic adjustment of the sole down-holding device causes the rubber block to experience a deformation even in the skiing position, and therefore it cannot dependably produce on initially calculated return force.

A further front jaw with a sole down-holding part biased by a compression spring is a state-of-the-art device shown in Austrian Patent Application No. A 1880/87, FIG. 5. This Austrian application corresponds to U.S. Pat. No. 4,960,289 issued Oct. 2, 1990 form U.S. Ser. No. 07/220 032 filed July 14, 1988. The sole down-holding part in this front jaw is moved by guide surfaces along the smooth bolt carrying the sole down-holding part, and also cannot be pivoted.

A purpose of the invention is to overcome these disadvantages of existing devices and to provide a front jaw in which the sole down-holding part can be rotated relative to the jaw housing and returns reliably to its center position after a twisting fall, even when the sole down-holding part, which is biased by a spring, is adjustable for different thicknesses of ski boot soles.

SUMMARY OF THE INVENTION

Starting out from a front jaw of the general type mentioned above, this purpose is attained inventively by providing, as the return spring which maintains the sole down-holding part in its center position, a U-shaped leaf or wire spring having a web divided into two sections by an approximately semicircularly curved section.

By inventively designing the return spring as a U-shaped, curved leaf or wire spring, the spring force can be dimensioned sufficiently strong so that, after a lateral deflection of the sole down-holding part, a return to its center position is reliably effected. Furthermore, the force transmitted from the sole down-holding part to the return spring is improved, since in the case of a twisting fall the sections of the spring separated from one another by the curved section become effective.

According to a further feature, the curved section of the return spring is arched and has the shape of an omega, a semicircle or half of an ellipse, and is connected to two section of the web through transition sections. This feature permits adjustment of the spring characteristic to a respective desired return force.

According to a further feature, two leg portions of the wire return spring are bent in their center regions to extend upwardly at an obtuse angle, and according to yet another feature the housing has a crosswall, and has a shoulder in the upper region of the crosswall which extends toward the ski boot and has therein a recess in which the leaf or wire return spring is disposed, the leaf or wire spring being supported with two legs on the crosswall and on two support surfaces on the shoulder. These features make the provision of the wire spring in and its support on the housing easier.

According to another feature, the web of the U-shaped wire return spring has two sections disposed in a groove which is provided in the sole down-holding part, which extends in a transverse direction, and which is V-shaped in cross section. This feature ensures that the centering action of the wire spring is maintained even when the sole down-holding device moves axially upwardly, and ensures that the action of the wire spring assists the compression spring for the automatic vertical adjustment of the sole down-holding device. The compression spring for the automatic vertical adjustment therefore need not be as strong as it otherwise would have to be.

According to still another feature, the ends of the two spring legs are bent at 90° with respect to the legs and extend in a direction toward a longitudinal center plane. This feature prevents damage to the housing.

BRIEF DESCRIPTION OF THE DRAWINGS

An exemplary embodiment of the inventive front jaw is described in detail hereinafter with reference to the drawings, in which:

FIG. 5 also showing the position of the spring in the jaw, which latest is marked by dotted lines.

DETAILED DESCRIPTION

Figure 1:
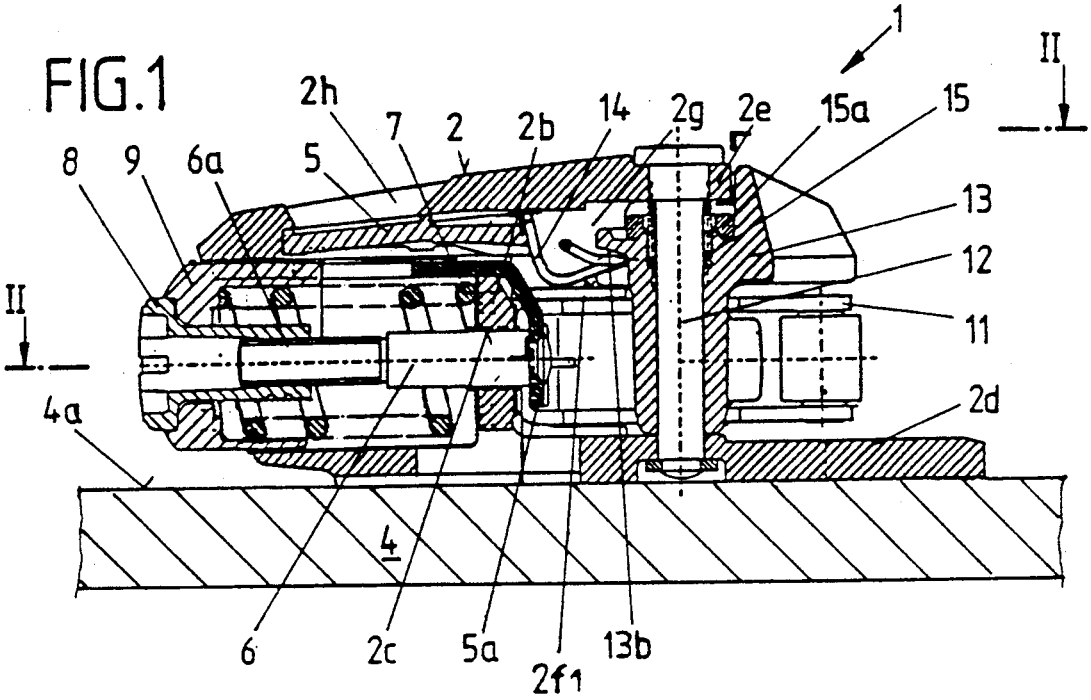
FIG. 1 is a cross-sectional side view of a front jaw embodying the invention.

The inventive front jaw is identified in its entirety with reference numeral 1 in FIGS. 1 to 4. It has a housing 2 secured by means of screws 3 on the upper side 4*a* of a ski 4. A slide member 5 bent to form approximately a right angle is guided for movement in the longitudinal direction of the ski in a recess 2*a* in the housing 2. The slide member 5 is riveted to a draw rod 6 extending through a compression spring 7 and carrying a thread 6*a* at its free end. The draw rod 6 extends through a hole 2*c* in a stepped crosswall 2*b* of the housing 2, the crosswall supporting one end of the spring 7. The initial tension of the spring 7 can be adjusted by rotating a threaded sleeve 8 screwed onto the thread 6*a* of the draw rod 6. A sleeve 9 encircles the threaded sleeve 8 and engages a head thereon, the sleeve 9 having the function of a spring support or washer and at the same time indicating the initial tension of the pressure spring 7. In particular, the initial tension can be read by viewing the axial position of sleeve 9 through a window 2*h*.

The housing 2 is forked (viewed in the side view of FIG. 3) at its end facing a ski boot 16, the lower fork prong 2*d* being longer than the upper fork prong 2*e*. The crosswall 2*b* of the housing 2 has in an upper portion facing the ski boot 16 a shoulder portion 2*f* (FIG. 4), in which is provided a prismatic recess 2*g* of trapeziform cross section, the purpose of which will be explained later (see also FIG. 5).

Two axles 10 for two toggle levers 11 extend vertically above the upper side 4*a* of the ski 4 and are secured in the lower fork prong 2*d* of the housing 2, the longer lever arms 11*a* of the toggle levers 11 being designed for contact with the ski boot 16. The ends of the shorter lever arms 11*b* of the two toggle levers 11 are located between the lower portion of the crosswall 2*b* of the housing 2 and a downwardly bent leg 5*a* of the slide member 5. A smooth bolt 12 is supported in the two fork prongs 2*d* and 2*e* of the housing 2, extends perpendicular to the upper side 4*a* of the ski 4, and is used to support a sole down-holding part 13. The part 13 is under the influence of a compression spring 15, which urges it downwardly. A damping ring 15*a* is arranged coaxially with respect to the pressure spring 15.

Figure 5:
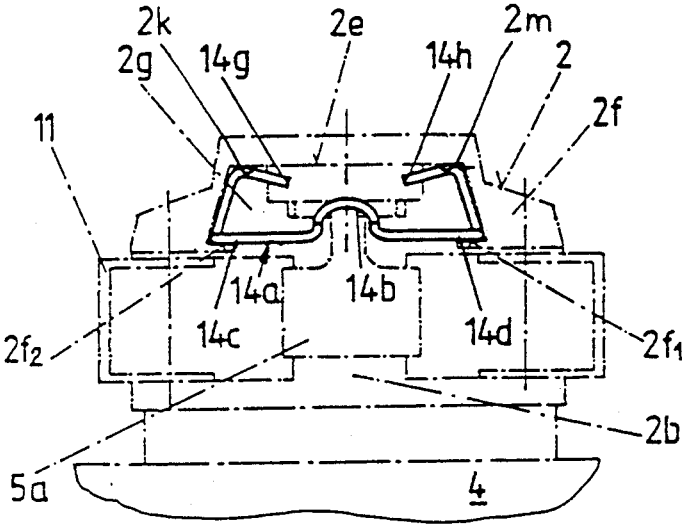
FIGS. 5, 6 and 7 are respectively a view from the back in the direction of the longitudinal axis of the jaw, a side view and a top view of a return spring which is a component of the jaw.
Figure 6:
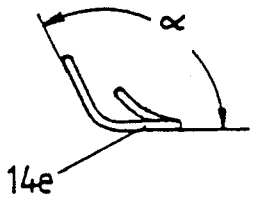
Figure 7:
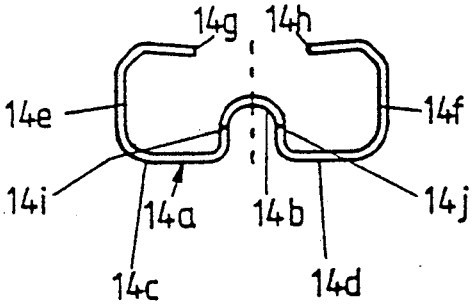

A horizontal groove 13*b* is provided in a boundary surface 13*a* of the sole down-holding device 13, which boundary surface 13*a* faces the tip of the ski and extends vertically. The groove 13*b* is, in the side view of FIG. 3, substantially V-shaped in cross section, with the boundary walls of the groove 13*b* being interrupted for technical manufacturing reasons. An approximately U-shaped wire spring 14 is used to return the down-holding device 13 to a centered position, and has its web 14*a* disposed in the groove 13*b* (see FIGS. 5–7). The web 14*a* is divided into two straight sections 14*c* and 14*d* by, for example, a semicircularly curved center section 14*b*, the curved center section being connected to the sections 14*c* and 14*d* by transition sections 14*i* and 14*j* (FIG. 7). Furthermore, two legs 14*e* and 14*f* of the wire spring 14 are bent upwardly at their centers so as to have portions extending at an obtuse angle $\alpha$, two end portions 14*g* and 14*h* of the two legs 14*e* and 14*f* being bent 90° relative to portions 14*e* and 14*f* to extend vertical longitudinal center plane of the wire spring 14.

Figure 2:
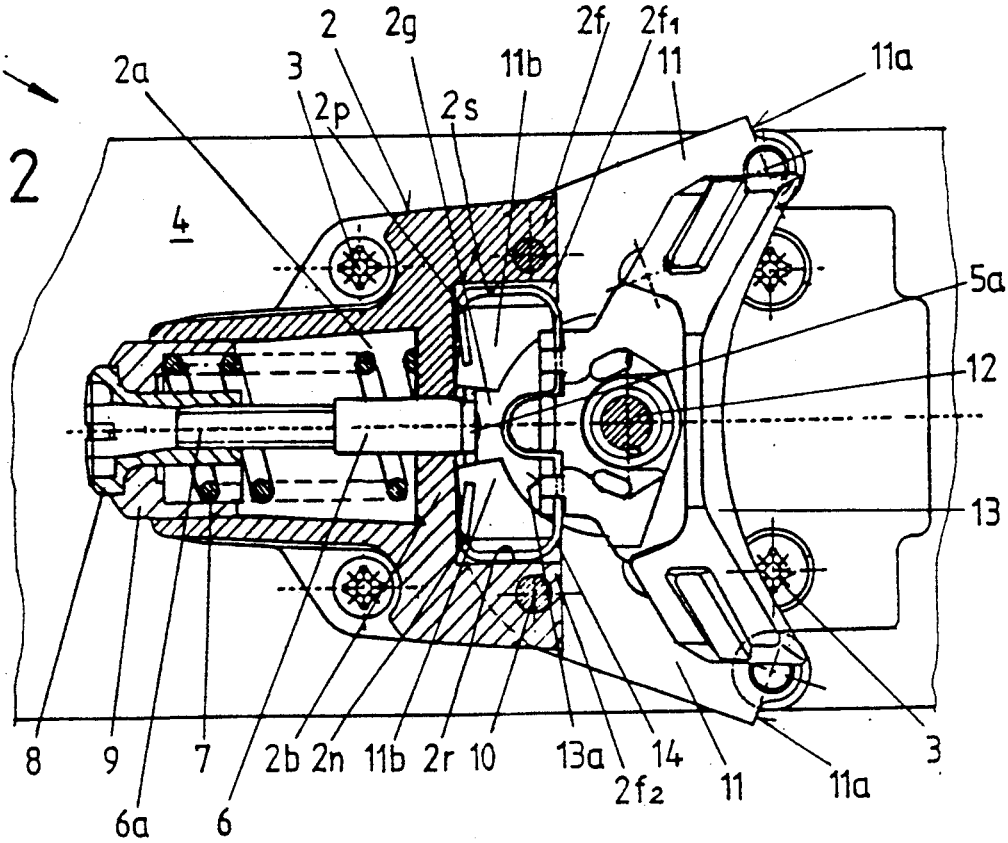
FIG. 2 is a top view of the jaw of FIG. 1, taken partly in cross section along the line II—II of FIG. 1.
Figure 3:
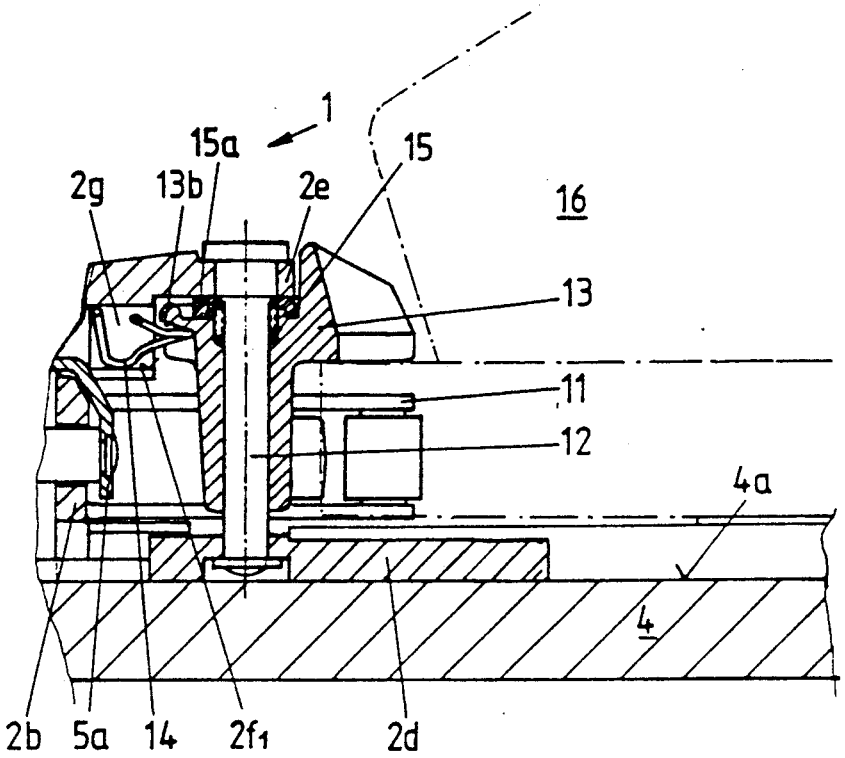
FIG. 3 is a fragmentary view similar to FIG. 1 but with an inserted ski boot shown in broken lines.

As shown in FIGS. 2 and 3 the wire spring 14 is disposed in the recess 2*g* in the shoulder portion 2*f* of the crosswall 2*b* of the housing 2 in a manner so that the legs 14*e* and 14*f* rest coplanar vertically on upwardly facing spaced support surfaces $2f_1$ and $2f_2$ of the shoulder portion 2*f* and have their free end portions 14*g* and 14*h* engaging respective vertically downwardly facing surface portions 2*k* and 2*m* on an underside of the upper fork prong 2*e* of the housing 2 and engaging the crosswall 2*b*. The surface portions 2*k* and 2*m* are offset laterally inwardly relative to the surface portions $2f_1$ and $2f_2$. Damage to the housing 2 is prevented by the end portions 14*g* and 14*h* of the two legs 14*e* and 14*f*.

Referring to FIG. 2, the housing 2 has in the recess 2*g* two surface portions 2i n and 2*p* which extend upwardly and face the sole holder 13, and which in the preferred embodiment are respective coplanar portions of a single surface on the crosswall 2*b*. The end portions 14*g* and 14*h* of the spring respectively engage the surface portions 2*n* and 2*p*. The housing 2 also has two spaced surface portions 2*r* and 2*s* on opposite sides of the recess 2*g* which extend upwardly and inwardly at an incline and face each other. The legs 14*e* and 14*f* of the spring respectively engage the surface portions 2*r* and 2*s*.

Figure 4:
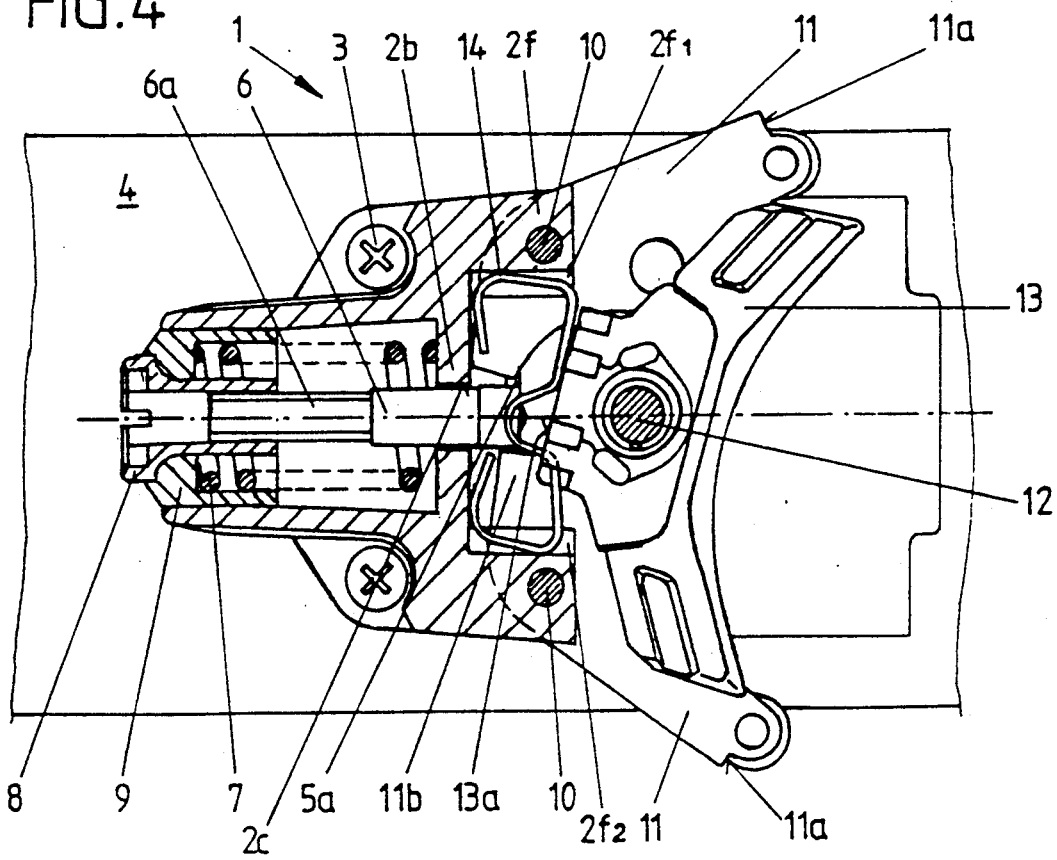
FIG. 4 is a partially sectional top view of the front jaw similar to FIG. 2, but with a sole down-holding part which is a component of the jaw deflected.

The wire spring 14 is, during skiing, normally in the position illustrated in FIGS. 1–3, in which the sole down-holding part 13 is in its center position. If the sole down-holding part 13 is now deflected during a twisting fall of the skier then, as illustrated in FIG. 4, both sections 14*c* and 14*d* of the web 14*a* of the wire spring 14 are slightly deformed through the base of the groove 13*b* of the sole down-holding part 13. This stress is divided onto both sections 14*c* and 14*d* of the wire spring 14, causing the biases in the wire spring to be reduced.

The spring 15 has the purpose of effecting an automatic adjustment of the vertical position of the sole down-holding part 13 to different height ski boot soles, with possible snow residues on the sole of a ski boot being thereby simultaneously compensated for. The wire spring 14, due to its design, supplements the function of the pressure spring 15, so that the latter, assuming the same conditions, can be dimensioned weaker, than if only one pressure spring alone is used.

Figure 8:
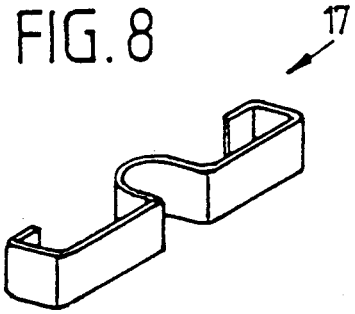
FIG. 8 is a perspective view of a leaf spring which is an alternative embodiment of the spring shown in FIGS. 5 to 7.

The embodiment of the return spring illustrated in FIG. 8 is constructed as a leaf spring 17, which can be used in particular for a non-automatically adjusted sole down-holding part. This leaf spring 17 has the advantage that a special design of the support surface on the sole down-holding device is not needed.

The invention is not limited to the aforedescribed exemplary embodiments illustrated in the drawings. Rather, various modifications of the same, including the rearrangement of parts, are possible without leaving the scope of the invention. The housing can, for example, be composed of a support member receiving the axles or the bolt and a housing for the spring.

The embodiments of the invention in which an exclusive property or privilege is claimed are defined as follows:

1. In a front jaw for a safety ski binding which includes a ski-fixed housing forked at a rear end to define vertically spaced prongs, two axles which are anchored in the housing and are perpendicular to an upper side of a ski, and two toggle levers which are each pivotally supported on a respective said axle and each have a long lever arm engageable with a ski boot and a short lever arm engageable with a slide member guided in the housing for movement in a longitudinal direction of the housing and biased by a release spring, and a sole down-holding part supported adjustably in a vertical direction between the two toggle levers on a bolt extending perpendicular to the upper side of the ski, said bolt being supported in the two prongs of the housing, and the sole down-holding part being pivotal about the bolt and being yieldably maintained in a center position by a centering spring, the improvement comprising the centering spring which maintains said sole down-holding part in the center position being a U-shaped spring having two spaced legs connected by a web which has two outer section connected by a curved section, the outer sections of the web engaging the sole down-holding part, and the legs each engaging the housing.

2. A front jaw according to claim 1, wherein said curved section has a shape of one of an omega, a semicircle and half of an ellipse, and is connected to said outer sections of the web of the centering spring by transition sections.

3. A front jaw according to claim 1, wherein the two legs of the centering spring are bent in center regions thereof to extend upwardly at an obtuse angle.

4. A front jaw according to claim 1, wherein said housing has a crosswall, and has a shoulder in an upper region of the crosswall which extends toward the ski boot and has therein a recess in which the centering spring is disposed, the shoulder having two support surfaces and the legs of the centering spring being supported on the crosswall and on the two support surfaces on the shoulder.

5. A front jaw according to claim 1, wherein said web of said U-shaped centering spring has said outer sections thereof disposed in a groove which is provided in said sole down-holding part, said groove extending in a transverse direction and being V-shaped in cross section.

6. A front jaw according to claim 1, wherein the two legs of the centering spring each have first and second portions, said second portions being at ends of said legs remote from said web, said second portions extending at approximately 90° with respect to said first portions, and said second portions each extending in a respective direction toward a longitudinal center plane.

7. A jaw for a safety ski binding, comprising: a housing; a sole holder supported on said housing for pivotal movement relative thereto about a generally vertical pivot axis, said sole holder being movable to a center position and being pivotal relative to said housing away from said center position in opposite directions; and a centering spring and mean supporting said centering spring on said housing, said centering spring having spaced first portions which are approximately straight and extend in approximately opposite directions, and having between said first portions a curved second portion, said first portions each engaging said sole holder; wherein said means supporting said centering spring includes said housing having two laterally spaced first surface portions each facing approximately in a first vertical direction and having two second surface portions facing approximately in a second vertical direction opposite said first vertical direction, and includes said centering spring being approximately U-shaped and having a web and two legs extending outwardly from opposite ends of said web, said web including said first and second portions, said legs each having an end portion remote from said web which engages a respective one of said second surface portions and each having between said web and said end portion thereof a central portion which engages a respective one of said first surface portions.

8. A jaw according to claim 7, wherein said end portion of each said leg is bent to extend approximately perpendicular to an adjacent portion of said leg.

9. A jaw according to claim &, wherein each said leg is bent at said central portion thereof to form an obtuse angle.

10. A jaw according to claim 7, wherein said second surface portions are located laterally inwardly of said first surface portions, and wherein said first surface portions face upwardly and said second surface portions face downwardly.

11. A jaw according to claim 7, wherein said means supporting said centering spring includes said housing having two third surface portions which extend upwardly and face said sole holder and two spaced fourth surface portions which extend upwardly and face each other, each said leg of said spring engaging a respective said fourth surface portion and said end portion of each said leg engaging a respective said third surface portion.

12. A jaw according to claim 11, wherein said housing has therein a recess, said centering spring being disposed substantially within said recess and said first, second, third and fourth surface portions being within said recess, and wherein said first surface portions are substantially coplanar, said second surface portions are respective portions of a common horizontal planar surface, said third portions are respective portions of a common vertical planar surface, and said fourth surface portions each extend upwardly and inwardly.

13. A jaw according to claim 12, including means supporting said sole holder for approximately vertical movement relative to said housing and means for yieldably urging said sole holder downwardly relative to said housing.

14. A jaw according to claim 7, wherein said sole holder has in a surface thereof a horizontally extending groove, said first portions of said spring each being disposed in said horizontally extending groove.

15. A jaw according to claim 14, wherein said groove has a V-shaped cross section.

16. A jaw according to claim &, wherein said second portion of said spring is approximately semicircular, and wherein said spring includes transition portions which each extend from a respective end of said semicircular second portion to one end of a respective said first portion.

17. A jaw according to claim 16, wherein said first portions have a respective said transition portion and a respective said leg extending outwardly from opposite ends thereof in different radial directions.

18. A jaw according to claim 7, wherein said centering spring is a single elongate piece of bent metal wire.

19. A jaw according to claim 7, wherein said centering spring is a leaf spring made from a single piece of bent metal.

* * * * *

UNITED STATES PATENT AND TRADEMARK OFFICE

CERTIFICATE OF CORRECTION

PATENT NO. : 5,028,069

DATED : July 2, 1991

INVENTOR(S) : Andreas JANISCH et al

It is certified that error appears in the above-identified patent and that said Letters Patent is hereby corrected as shown below:

Column 5, line 13; replace "section" (first occurrence) with ---sections---.

Column 6, line 11; replace "Claim &" with ---Claim 7---.

Column 6, line 49; replace "Claim &" with ---Claim 7---.

Signed and Sealed this

Twenty-second Day of December, 1992

*Attest:*

DOUGLAS B. COMER

*Attesting Officer*

*Acting Commissioner of Patents and Trademarks*